US005724749A

United States Patent [19]

Puumalainen et al.

[11] Patent Number: 5,724,749

[45] Date of Patent: Mar. 10, 1998

[54] SIPHON FOR REMOVING CONDENSATE FROM A PLANAR BAND

[75] Inventors: Jarmo Puumalainen, Tampere; Tero Toikka, Kangasala, both of Finland

[73] Assignee: Valmet Corporation, Helsinki, Finland

[21] Appl. No.: 789,276

[22] Filed: Jan. 28, 1997

[30] Foreign Application Priority Data

Apr. 12, 1996 [FI] Finland ..... 961641

[51] Int. Cl.[6] ..... F26B 13/26

[52] U.S. Cl. ..... 34/95; 34/335

[58] Field of Search ..... 34/95, 335, 618

[56] References Cited

U.S. PATENT DOCUMENTS

| | | | |
|---|---|---|---|
| 4,461,095 | 7/1984 | Lehtinen | 34/41 |
| 4,461,096 | 7/1984 | Suzuki | 34/56 |
| 4,477,287 | 10/1984 | Kush et al. | 134/15 |

FOREIGN PATENT DOCUMENTS

| | | |
|---|---|---|
| 61537 | 2/1981 | Finland . |
| 62694 | 6/1981 | Finland . |
| 78755 | 1/1988 | Finland . |
| 83247 | 6/1990 | Finland . |
| 90676 | 1/1993 | Finland . |
| 3148948 | 12/1983 | Germany . |

*Primary Examiner*—Henry A. Bennett
*Assistant Examiner*—Dinnatia Doster
*Attorney, Agent, or Firm*—Ladas & Parry

[57] ABSTRACT

A siphon for removing condensation water from the surface of a planar band. The siphon comprises a slide shoe, and at least one loading element for pressing the slide shoe so that it is substantially in contact with the surface of the band.

6 Claims, 2 Drawing Sheets

SIPHON FOR REMOVING CONDENSATE FROM A PLANAR BAND

Figure 1:
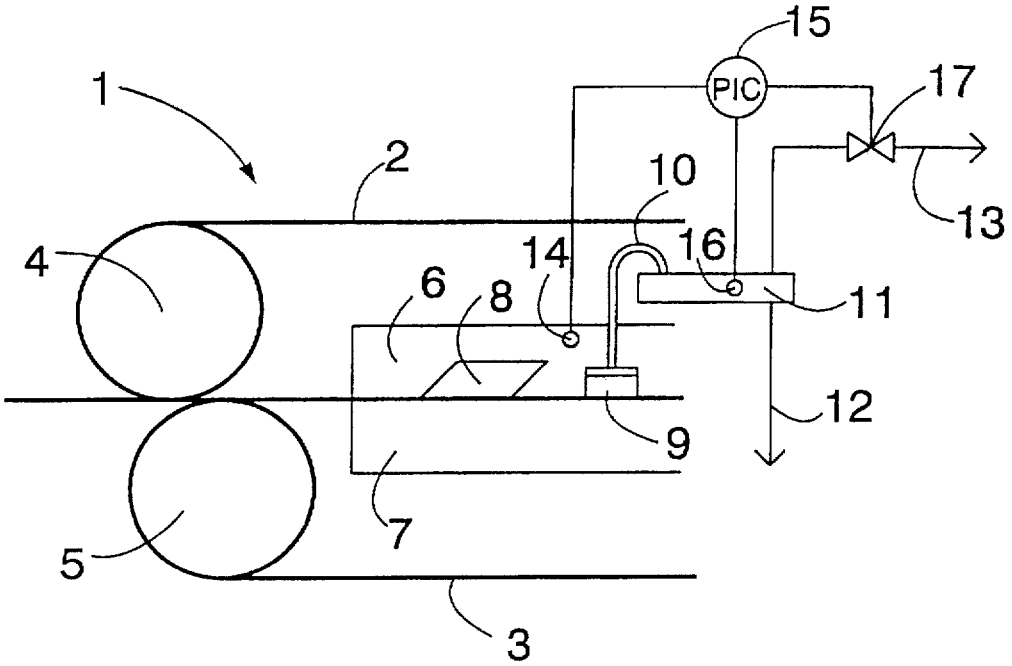

The invention relates to a siphon for removing condensate from the surface of a planar band, said siphon comprising an inlet opening on the side facing the surface for conducting the condensate into the siphon, and a discharge channel for removing the collected condensate from the siphon.

Siphons are used for removing condensate in drying cylinders of papermaking machines or the like. A siphon is mounted at a certain height from the lining of a drying cylinder; its distance from the surface and position in relation thereto are constant. The siphon is used for sucking condensate accumulated on the lining. The condensate is removed through a channel provided at the end of the collector opening. Siphons of this type are disclosed in, for example, DE 31 48 948, FI 62694, FI 83247 and FI 90676.

In the "Condebelt" technique, a fibre web is dried between two planar metal bands in such a way that the bands run in parallel with each other over a distance. Steam is typically used as a heating medium for heating one of the steel bands; part of the steam condenses on the surface of the band and should be removed therefrom. This drying technique is fully known per se from, for example, U.S. Pat. No. 4,461,095, FI 61537 and FI 78755.

When a narrow drying apparatus is used, the condensate is removed for the most part by means of leaks through a gap between a steam chamber mounted against the upper surface of the band and the surface of the band. The wider the drying apparatus is, the more difficult it is to remove the condensate, as the amount of condensate increases with the width. In the known cylinder drying arrangements, the position of the drying cylinder and the position of the siphon are constant in relation to each other, since the thickness of the web and other similar factors do not affect the relation between the cylinder surface and the siphon. In drying effected between bands, in turn, the upper band is placed in a different position in the vertical direction according to the thickness of the web to be dried. This causes difficulties in the use of the conventional siphon technique: when the layer of condensate is very thin, the siphon must be either very close to the band surface or even in contact with it. As a result of this, siphons that are fixedly mounted by the conventional technique either do not remove the condensate sufficiently well or they may be damaged or damage the steel band.

The object of the present invention is to provide a siphon structure which avoids the drawbacks associated with the prior art and which allows condensate to be efficiently removed from the surface of a planar steel band. The siphon of the invention is characterized in that it further comprises a separate slide shoe which is substantially planar on the side facing the surface of the band, said slide shoe being intended to be in contact with the surface of the band, and at least one loading element for pressing the slide shoe towards the surface of the band.

An essential feature of the invention is that a siphon with a planar bottom is mounted so as to be movable substantially perpendicularly in relation to the surface. A further essential feature of the invention is that one or more loading elements act on the siphon for pressing the siphon towards the surface of the steel band so that the siphon remains substantially in contact with the surface irrespective of the changes in its position. Yet another essential feature of the invention is that the siphon comprises a separate wear piece, which, under the action of the loading element, remains in contact with the band surface while wearing down.

Figure 2:
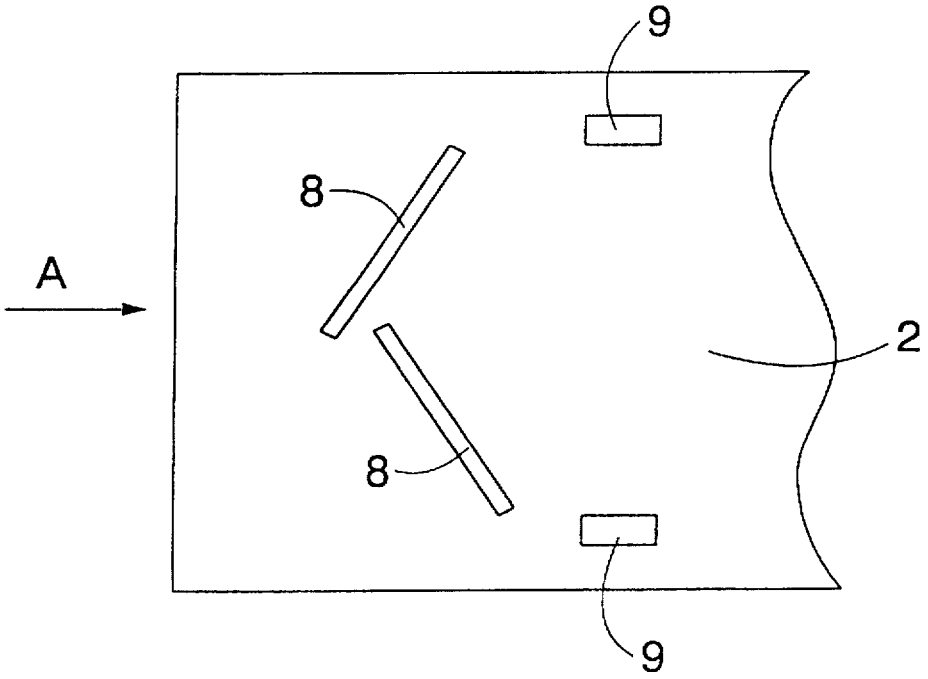
Figure 3:
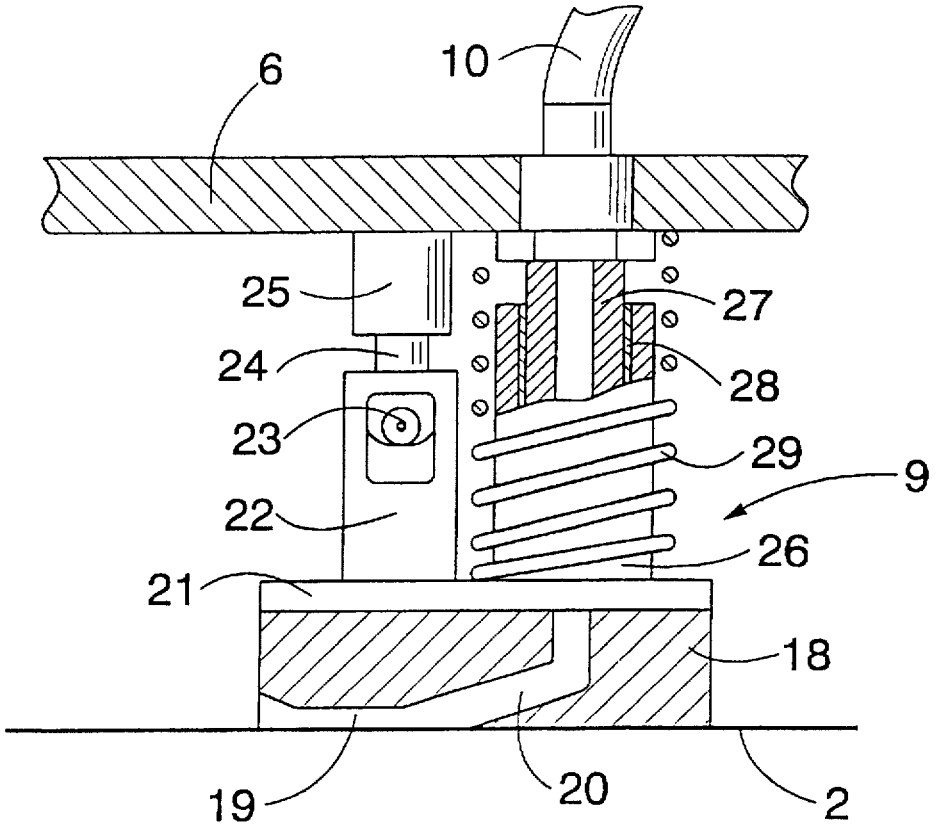
Figure 4:
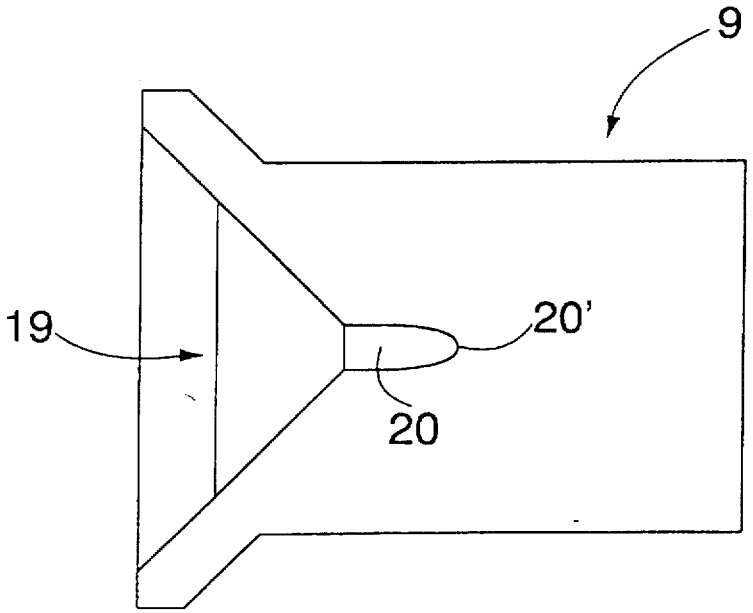

In the following, the invention will be described in greater detail with reference to the accompanying drawings, in which FIG. 1 is a schematic, sectional side view of a part of a drying apparatus, FIG. 2 is a schematic view of a siphon and a doctor blade arrangement, seen from the top of the band, FIG. 3 is a schematic, partially sectional side view of the siphon of the invention, and FIG. 4 is a schematic view of the siphon of FIG. 3, seen from below.

FIG. 1 is a schematic, sectional side view of a part of a drying apparatus 1. The drying apparatus comprises continuous bands 2 and 3, which turn around rolls 4 and 5 and correspondingly around similar rolls (not shown) at the other end of the drying apparatus 1, each of the bands forming thus a separate closed loop. A steam chamber 6 for heating the upper band 2 typically with steam is provided inside the loop formed by band 2. Correspondingly, a cooling chamber 7 for cooling the lower band 3 with water flowing through it is provided inside the loop formed by band 3. The steam chamber 6 is schematically shown to comprise a doctor blade 8, by which condensate accumulated on the surface of the band 2 is guided towards the edges of the band. It is also shown to comprise a siphon 9 and a water discharge channel 10 leading from the siphon 9 out of the steam chamber 6. The channel 10 leads to a separating chamber 11, where the condensation water and steam are separated from each other. The water is discharged through a channel 12, and steam is sucked out through a channel 13. In order for a correct pressure difference to be maintaned between the steam chamber 6 and the separating chamber 11 and the condensation water to be sucked out through the siphon efficiently enough, a sensor 14 is connected from the steam chamber 6 to a pressure regulator 15, to which another sensor 16 is further connected from the separating chamber 11. The pressure regulator 15 controls a regulating valve 17 of the steam discharge channel 13 such that the pressure of the separating chamber 11 remains at a desired level, and the condensate is, moreover, discharged as desired.

FIG. 2 illustrates how two siphons 9 and two doctor blades 8 are mounted within the loop formed by band 2, against the surface of the band. The doctor blades 8 are mounted obliquely with respect to the direction of travel A of the band 2 so that they guide condensate on the surface of the band towards the outer edges of the band 2. The siphons 9 are aligned with the outer ends of the doctor blades 8. Each siphon 9 collects the condensation water guided to that edge of the band 2 where it is positioned, and removes it from the steam chamber.

FIG. 3 is a schematic, partially sectional side view of an embodiment of the siphon 9. The siphon 9 is secured to the cover of the steam chamber 6. The siphon 9 comprises a slide shoe 18 which is in contact with the surface of the band 2. The figure shows a sectional view of the slide shoe 18; it can thus be seen from the figure that the slide shoe 18 comprises a water collection opening 19 and a discharge channel 20 leading therefrom out of the slide shoe 18. The slide shoe 18 is secured to the body 21, since it must be possible to replace the slide shoe 18 when it wears down. The body 21, in turn, is connected by an arm 22 to an eccentric lever 23; by turning the lever 23, the siphon 9 can be lifted off the surface of the band 2. The arm 22 is further connected to a guide pin 24, which is provided inside a guide bushing 25 mounted on the cover of the steam chamber 6, for keeping the siphon in the right direction. The body 21 further comprises a channel bushing 26. An extension bushing 27 extends downwards from the cover of the steam chamber 6 to inside the channel bushing 26. A seal 28 is provided between the channel bushing 26 and the extension bushing 27. The channel 20 extends through the channel bushing 26 and continues as a discharge channel 10 running through the extension bushing 27. A continuous discharge channel is thus provided from the siphon 9 for removing the condensate accumulated and steam from the steam chamber 6. A spring 29 serving as a loading element is mounted around the channel bushing 26. The spring 29 bears on the cover of the steam chamber 6 and presses the surface of the body 21 so as to push the siphon 9 down towards the first band 2. Thus the siphon 9, more specifically its slide shoe 18, is substantially continuously in contact with the upper surface of the band 2, irrespective of the position of the band 2 in the vertical direction. The opening provided in the arm 22 for the eccentric lever 23 is dimensioned in such a manner that when the slide shoe 18 has worn down to a predetermined extent, its movement towards the band 2 is prevented, whereby the body 21 cannot damage the band 2. If necessary, the eccentric lever 23 can be turned from outside the steam chamber 6 so that, if desired, the siphons can be lifted off the surface of the band 2.

FIG. 4 illustrates the shape of the siphon 9, seen from below. As can be seen from the figure, the inlet opening 19 of the siphon is wide in the transverse direction of the siphon 9, and triangular in shape, converging towards the rear end of the siphon, as shown in the figure. The siphon therefore collects condensate into itself over almost the entire width thereof. As appears from FIG. 3, the front edge of the inlet opening 19 may be higher than the rest of the opening such that the height of the inlet opening 19 decreases over a distance from the front edge towards the rear end. This allows the condensation water to collect at the inlet opening instead of splashing all over. FIG. 4 further illustrates how the channel 20 begins from the rear end of the inlet opening 19 in such a way that the rear edge 20' of the channel 20 "cuts" the condensate off the surface of the band 2.

In the specification above and in the drawings, the invention is illustrated merely by way of example, and it is in no way limited to this example. The siphon may have various shapes and structures provided that it comprises means for pressing the siphon towards the band surface. In addition, the slide shoe 18 can be implemented in many different ways and from different materials. Furthermore, the slide shoe 18 may be secured to the body 21 in different ways.

We claim:

1. A siphon for removing condensate from the surface of a planar band, said siphon comprising an inlet opening on the side facing the surface for conducting the condensate into the siphon, and a discharge channel for removing the collected condensate from the siphon, a separate slide shoe which is substantially planar on the side facing the surface of the band, said slide shoe being intended to be in contact with the surface of the band, and at least one loading element for pressing the slide shoe towards the surface of the band.

2. A siphon according to claim 1, wherein the slide shoe is a separate wear piece, the siphon comprises a body to which the slide shoe is secured, and the loading element is arranged to push the body and thereby the slide shoe towards the surface of the band.

3. A siphon according to claim 2, wherein the inlet opening in the slide shoe is at its inlet edge substantially of the same width as the slide shoe and converges towards the rear end of the slide shoe in the direction of travel of the band.

4. A siphon according to claim 3, wherein the front edge of the inlet opening is higher at the front end of the slide shoe and becomes lower towards the rear end of the slide shoe.

5. A siphon according to claim 2, wherein the body is mounted on the cover of the steam chamber facing the band so as to be movable substantially perpendicularly in relation to the band, and that the loading element is a spring provided between said cover and the siphon body.

6. A siphon according to claim 5, comprising guiding means which allow the siphon to move in a direction perpendicular to the band, and the guiding means comprise stopper elements for stopping the movement of the siphon towards the band when the slide shoe has worn down to a predetermined extent.

* * * * *